United States Patent [19]

Ahlgren

[11] Patent Number: 4,497,483

[45] Date of Patent: Feb. 5, 1985

[54] DEVICE FOR DIVIDING ICE-HOCKEY RINKS

[76] Inventor: Göran Ahlgren, Pl 1421, S-790 30 Insjön, Sweden

[21] Appl. No.: 514,829

[22] PCT Filed: Oct. 21, 1982

[86] PCT No.: PCT/SE82/00340

§ 371 Date: Jun. 20, 1983

§ 102(e) Date: Jun. 20, 1983

[87] PCT Pub. No.: WO83/01390

PCT Pub. Date: Apr. 28, 1983

[30] Foreign Application Priority Data

Oct. 21, 1981 [SE] Sweden ..... 8106215
Mar. 18, 1982 [SE] Sweden ..... 8201730

[51] Int. Cl.[3] ..... A63C 19/06; E04H 17/16

[52] U.S. Cl. ..... 272/3; 52/6; 62/235; 256/24; 273/1 B

[58] Field of Search ..... 272/3, 19, 5, 4; 62/235; 256/24, 25, 29, 30, 31, 73; 52/6, 7, 245, 247; 273/1 B

[56] References Cited

U.S. PATENT DOCUMENTS

| | | | |
|---|---|---|---|
| 3,012,596 | 12/1961 | Skolout | 62/235 X |
| 3,194,361 | 7/1965 | Thurman | 256/24 X |
| 3,237,936 | 3/1966 | Plante | 272/4 |
| 3,709,489 | 1/1973 | Holleran et al. | 272/3 X |
| 3,883,120 | 5/1975 | Tippmann | 272/3 X |
| 3,986,342 | 10/1976 | MacCracken | 272/3 X |
| 4,014,521 | 3/1977 | Berman | 256/24 X |
| 4,038,834 | 8/1977 | Roberts | 272/3 X |
| 4,392,647 | 7/1983 | Golebieski | 273/1 B X |

FOREIGN PATENT DOCUMENTS

| | | | |
|---|---|---|---|
| 276718 | 12/1969 | Austria | 256/24 |
| 2063956 | 6/1981 | United Kingdom | 256/24 |

*Primary Examiner*—Robert Bagwill
*Assistant Examiner*—Arnold W. Kramer
*Attorney, Agent, or Firm*—Bacon & Thomas

[57] ABSTRACT

A device for dividing an ice-hockey rink into at least two smaller rink parts comprises a plurality of straight sideboard elements (8*a*) and a plurality of curved sideboard elements (8*b*). The sideboard elements (8*a*, 8*b*) are provided with means (16, 20, 21) for interconnecting the same while forming a supplemental sideboard (8, 9) which when placed across the ice-hockey rink together with the stationary sideboard (1), encloses a smaller rink (5, 7) having symmetrical curved corners.

9 Claims, 10 Drawing Figures

DEVICE FOR DIVIDING ICE-HOCKEY RINKS

The present invention relates to a device which makes it possible to rapidly and conveniently divide a regular ice-hockey rink into at least two smaller enclosed rink parts, at least one of which has essentially the same shape as the regular rink, i.e. having curved and symmetric corners.

A big problem in connection with ice-hockey training and matches for children and youngsters is that the regular ice-hockey rink is too big, so that the children-/youngsters are unable to make use of the entire field. Another—and related—problem is that comparatively few children/youngsters can practice or play on the big rink simultaneously. Thus, the rink is poorly utilized, which is disadvantageous to the activities for young players. An efficient utilization of the rink is desirable, not the least because of the costs for renting the rink, which are often high.

It is an object of the invention to solve i.a. these and related problems, and to this end there is according to the invention provided a device for dividing, or partitioning, a regular ice-hockey rink into smaller, enclosed areas, which device has been given the characteristic features, which are indicated in the appended claims and will be explained further below.

Figure 1:
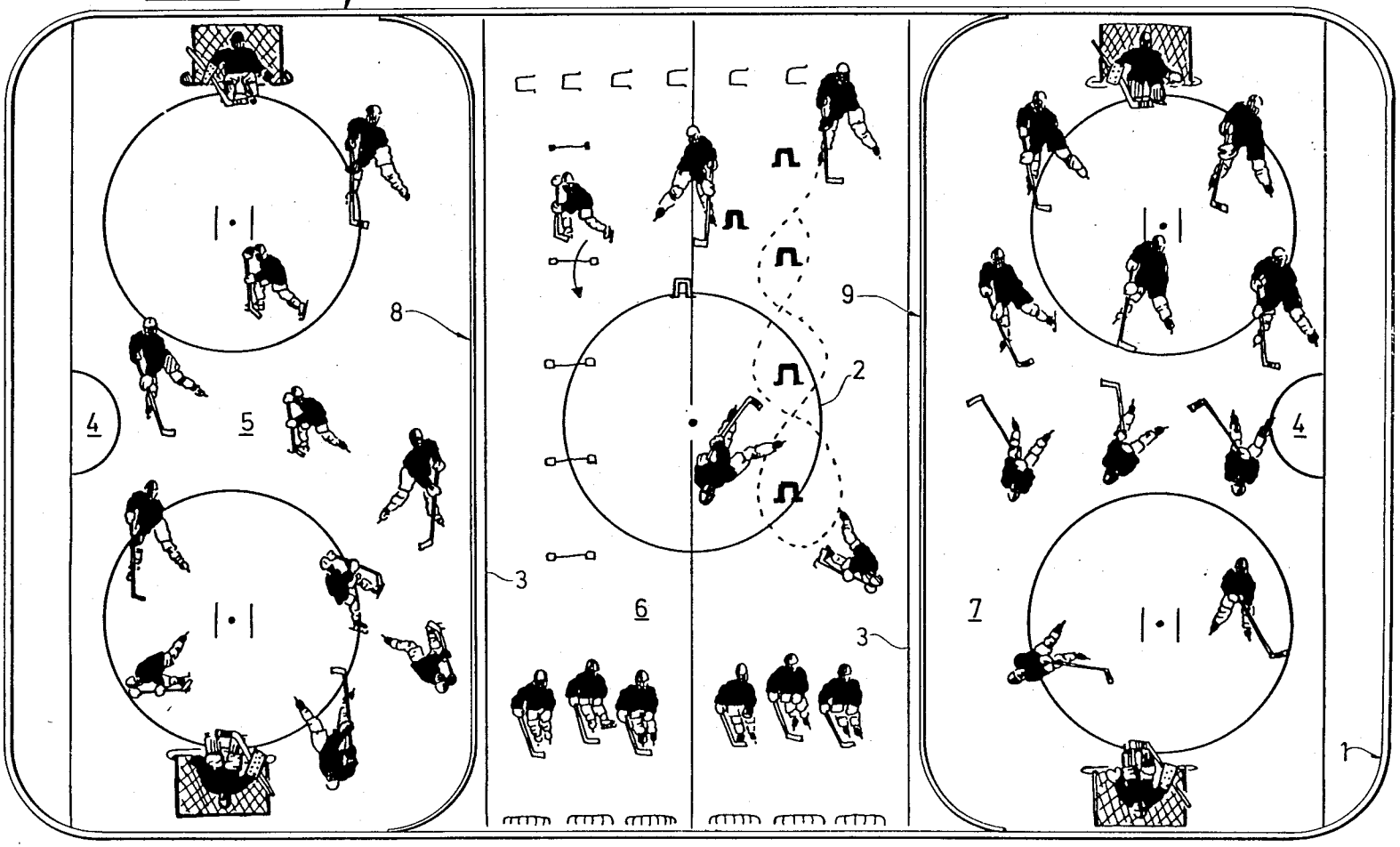
Figure 2:
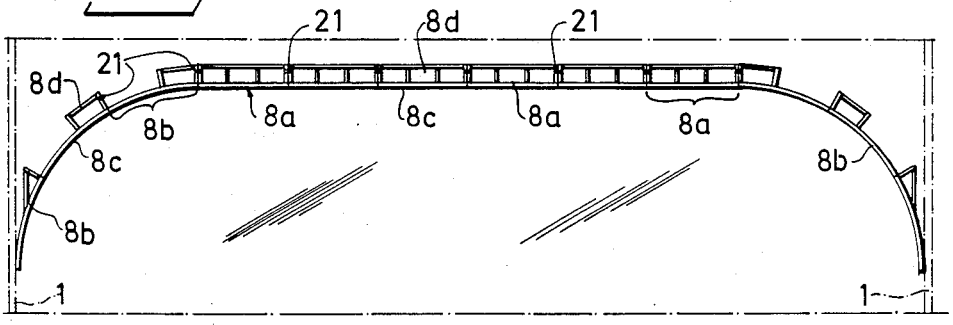
Figure 3:
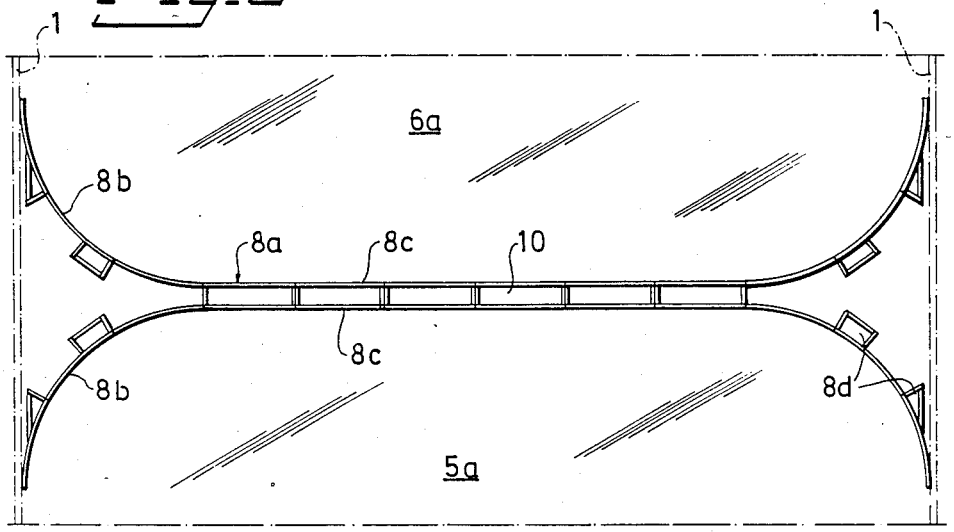
Figure 8:
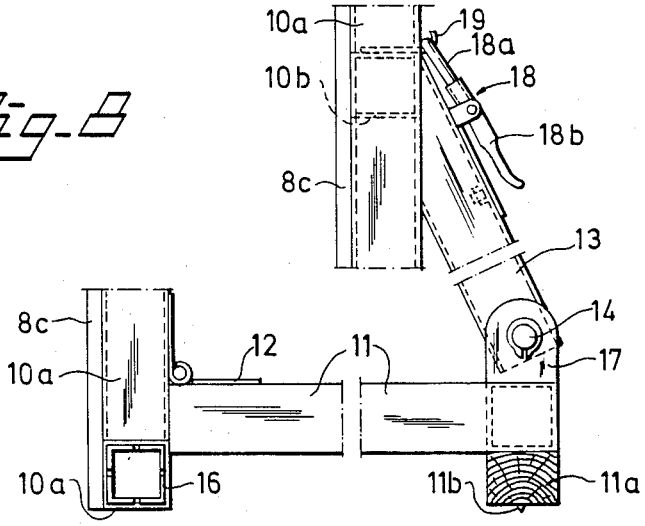
Figure 4A:
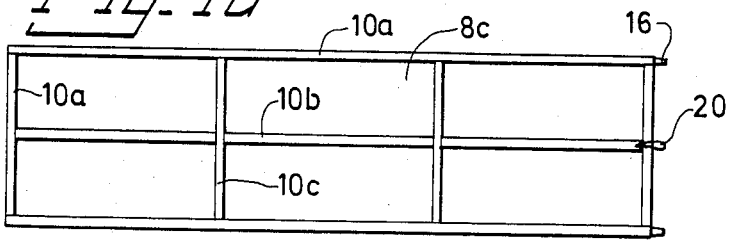
Figure 4B:
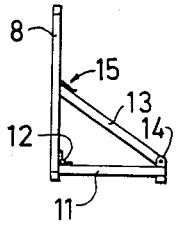
Figure 5A:
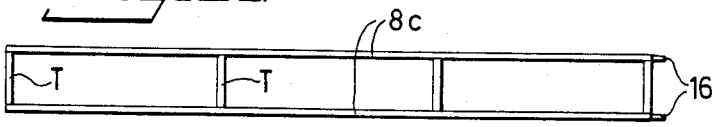
Figure 5B:
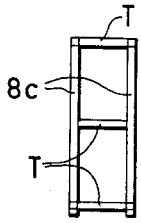
Figure 6:
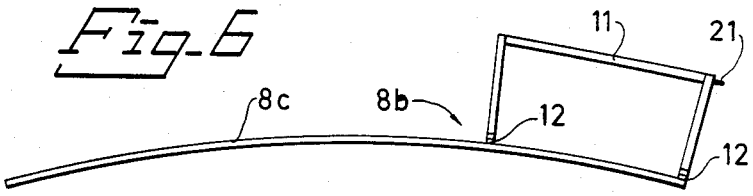
Figure 7:
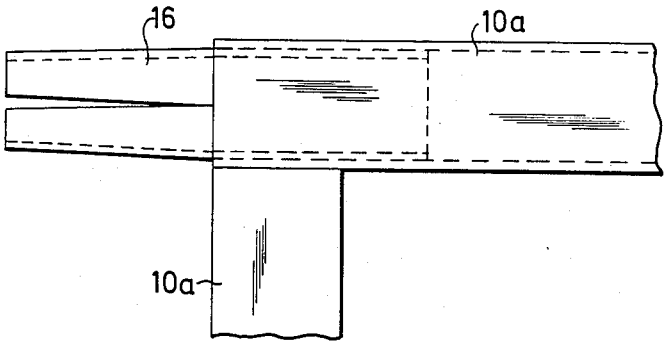

The invention will be explained in more detail in the following description with reference to the enclosed drawings, wherein:

FIG. 1 is a schematic top plan view of a conventional ice-hockey rink, which has been divided into three separate training sections by means of two supplemental sideboards according to the invention, FIG. 2 is a more detailed top plan view of a first embodiment of a mounted supplemental sideboard according to the invention, FIG. 3 is a view similar to FIG. 2 and showing an alternative embodiment of the mounted supplemental sideboard according to the invention, FIGS. 4*a* and 4*b* schematically show a first embodiment of a straight sideboard element according to the invention shown in side elevational view and end view respectively, FIGS. 5*a* and 5*b* show an alternative embodiment of a straight sideboard element according to the invention in longitudinal section and cross-section respectively, FIG. 6 is a schematic top plan view of one embodiment of a curved sideboard element according to the invention, FIG. 7 is a schematic detail view showing one embodiment of guide means for interconnecting two adjacent sideboard elements, and FIG. 8 is a schematic detail view which in enlarged scale shows a preferred embodiment.

FIG. 1 schematically shows a conventional ice-hockey rink having a stationary sideboard 1, a mid-circle 2, blue lines 3, goal areas 4, etc. According to the invention this full-scale rink has been divided into three transversely extending smaller "rinks" or sectors 5, 6 and 7 by means of two mountable supplemental sideboards 8 and 9. Each such supplemental sideboard consists of a plurality of interconnected straight sideboard elements and curved sideboard elements. The straight sideboard elements are at a suitable distance from the end of the stationary sideboard 1, e.g. essentially at the respective blue line 3, the curved sideboard elements interconnecting between the outermost of the straight sideboard elements and the stationary sideboard 1. The curvature of the interconnected curved sideboard elements correspond to the curvature of the corners of the stationary sideboard 1. In the case shown in FIG. 1 there are thus formed two fully fenced-in or enclosed "mini hockey rinks" 5 and 7, essentially corresponding to the rink 1, but of smaller dimensions, and therebetween also the sector 6, which is also fenced-in by the sideboards 8, 9.

Because of this division the ice-hockey rink 1 can be utilized optimally, e.g. as illustrated by the sketchings in FIG. 1. In this case the mini ice-hockey fields 5 and 7 are used for game training with two goals, whereas the mid-sector 6 is used for technique training, but this sector can, of course, also be used for other skating activities. Of course, it is also within the invention possible to use only one of the supplemental sideboards (8 or 9).

FIG. 2 is a more detailed illustration of the build-up of the supplemental sideboard from individual straight sideboard elements 8*a* and curved sideboard elements 8*b*. In a preferred embodiment six straight sideboard elements 8*a* and three curved sideboard elements 8*b* at each end thereof are used for a normal size rink. Each sideboard element essentially consists of an upright, actual sideboard portion 8*c* having a smooth inner surface, and support means 8*d* located on the outer side and serving to assist in keeping the supplemental sideboard in place when subjected to strain during games and training (body checks, etc.). The support means 8*d* can have different design for different sideboard elements, e.g. different design for straight and curved sideboard elements. Preferred embodiments of the support means will be described below.

In the embodiment shown in FIG. 3 the straight sideboard elements 8*a* consist of two actual sideboard parts 8*c*, which are kept secured at a suitable spacing (e.g. about 25 cms) by means of suitable cross-bars T (compare FIGS. 5*a* and 5*b*). Because of this construction the sideboard elements are substantially "self-supporting", and separate support means (corresponding to elements 8*d* in the embodiment of FIG. 2) can be omitted. When using this embodiment two mini-rinks 5*a*, 6*a* can be provided next to each other.

FIGS. 4*a* and 4*b* illustrate a preferred design of the straight sideboard sections in the embodiment of FIG. 2. The actual sideboard parts of each straight sideboard section consists of one (or possibly more) smooth sideboard plates 8*c* of a suitable material, such as hard plastic plates, to which are attached a plurality of supporting battens 10, preferably profiled aluminum tubes. In the shown preferred embodiment the same comprise edge or margin battens 10*a*, horizontal mid-battens 10*b*, and vertical mid-battens 10*c*. In this embodiment the above-mentioned support means 8*d* consist of a frame 11, which is pivotingly connected to the actual sideboard part 8*c* at the bottom thereof, e.g. by means of hinges 12, so that the frame can be pivoted upwards from the horizontal working position shown in FIG. 4*b* to a transport position against the plate 8*c*. Further, there is provided one (or more) locking arms 13, one end of which is pivotingly supported by the frame 11 by means of a joint 14, and the opposite end of which can be removably fastened (at 15) to the sideboard part 8*c* a certain distance from the bottom thereof, so as to keep the sideboard part 8*c* firmly in a position perpendicular to the support frame 11 (and consequently to the ice).

In the straight sideboard elements or sections 8*a* the respective frame 11 preferably has the same extension in the longitudinal direction as the sideboard element, as is illustrated in FIG. 2. The curved sideboard elements 8*b* are constructed in analogy with the straight sideboard elements 8*a* just described, but as appears from FIG. 6 (see also FIG. 2) the support frame 11 only extends over part of the length of the curved sideboard element (for the sake of simplicity), preferably starting from one end thereof, so that the frame can be fastened to an adjacent sideboard element, as will be explained in connection with FIG. 8. The curved sideboard element of FIG. 6 can be used together with both of the two types of straight sideboard elements, i.e. those of FIG. 2 and FIG. 3 respectively.

FIG. 7 illustrates suitable means for guiding adjacent sideboard elements into the correct mutual position. In this preferred embodiment the sideboard sections 8*a*, 8*b* are, at the top and the bottom of one short end, provided with a projecting male means, e.g. a bevelled steel pin or a slotted square tube 16, fitting into corresponding female means provided in the adjacent sideboard section at said short end, and the other way around at the opposite short end. The male and female means are preferably provided in the top and bottom light metal tubes 10*a* (e.g. square tubes of aluminum, 30×30×2 mm) of the sideboard elements. The female means may be formed by the very cavity of the square tubes 10*a*.

FIG. 8 shows in more detail a preferred embodiment of a sideboard element according to FIG. 4, certain parts of the support frame 11 and the lock arm 13, as well as of the vertical edge batten 10*a*, being omitted for space economy reasons (the edge batten 10*a* also being parallel shifted).

FIG. 8 clearly illustrates how the support frame 11 is attached to one of the horizontal battens 10*a* (carrying the sideboard plate 8*c*) by means of the hinge 12. The sideboard plate 8*c* can e.g. be 6–8 mm thick Worblex PE5258. The construction is preferably such that the frame 11 substantially only can be pivoted upwards in the hinge joint from the shown position, e.g. because of the frame 11 contacting the batten 10*a*. At the outer end the underside of the frame 11 preferably has a wooden fillet 11*a* for contacting the ice. If desired, the same can be provided with a friction covering, projecting tips or pins 11*b* or the like for enhancing the grip with the ice. The outer end of the lock arm or clamping arm 13 is pivotable relative to the support frame 11 by means of the shaft 14 and yoke 17 for the same. The opposite end of the arm 13 is provided with a so-called eccentric lock 18, which cooperates with a locking pin 19 on the batten 10*a*. As is known such locks have a locking ring 18*a*, which is made to engage the locking pin 19, the clamping then being performed by means of a tightening lever 18*b*, which is pressed against the support arm 13. As shown, the end of the latter is preferably bevelled, with an angle corresponding to vertical position of the actual sideboard.

The above described supplemental sideboard can be mounted on a regular ice-hockey rink very rapidly and conveniently. Each sideboard section of the described design (about 3 m long and made of the indicated materials) does not weigh more than one man can carry it and mount it. Because the support frame 11 can be folded up towards the very sideboard, the section occupies little space when transported and stored. When unfolding the frame 11 to the position shown in FIG. 8 and tightening the eccentric lock 18, each section rests by itself on the ice. The next section is mounted by bringing the male and female parts, serving as guiding and attachment means, into engagement with each other. The sections are locked to each other by suitable locking means acting between the end edge profiles of the up-right sideboard part, and also by suitable locking means acting between the horizontal support frames 11 of the two sideboard sections. The first-mentioned locking means are schematically indicated at 20 in FIG. 4*a*, and the latter at 21 in FIG. 2. Both locking means are preferably tightening devices, especially eccentric locks similar to the lock 18 for the support arm 13. The thusly designed supplemental sideboard has proven to be very expedient and stable.

The invention is, of course, not limited to the embodiments, which have been specifically described above and shown in the drawings, but many modifications and variations are possible within the scope of the appended claims and equivalents thereof.

I claim:

1. A device in combination with an ice-hockey rink for dividing the rink into at least two smaller rink parts, characterized in that it comprises a plurality of straight sideboard elements (8*a*) and a plurality of curved sideboard elements (8*b*), and in that the sideboard elements (8*a*, 8*b*) are provided with means (16, 20, 21) for interconnection thereof so as to form a supplemental sideboard (8, 9) which, when placed across the ice-hockey rink, together with the stationary sideboard (1) of the rink encloses a smaller rink (5, 7) having symmetrically curved corners.

2. A device according to claim 1, characterized in that said interconnecting means comprise guide means (16, 10*a*), especially of the male/female type, for securing that those surfaces of the actual sideboard parts, which face the enclosed rink, are flush with each other when said sections are interconnected.

3. A device according to claim 3, characterized in that said guide means are provided both at the top and at the bottom parts of said actual sideboard part (8*c*).

4. A device according to claim 1, characterized in that each sideboard element comprises an upright, actual sideboard part (8*c*) and a support part (8*d*, 11), which is pivotingly carried by said up-right part at the lower end thereof, said support part being pivotable between a transport position, in which it is folded towards the actual sideboard part, and a working position, in which it is essentially horizontal and perpendicular to the actual sideboard part(8*c*), that fastening means (13, 18, 19) are provided for removably securing said support part in said working position.

5. A device according to claim 2, characterized in that the sideboard elements comprise first locking means (20) for interlocking the actual sideboard parts (8*c*) of adjacent sideboard elements (8*a*, 8*b*), and second locking means (21) for interlocking said support parts (8*d*, 11) of adjacent sideboard elements when the support parts are in the working position.

6. A device according to claim 5, characterized in that said first and second locking means (20 and 21 respectively) consist of clamping devices of the eccentric lock type.

7. A device according to claim 2, characterized in that said support part comprises a frame structure (11), especially of light metal profiled tubes, which is pivotingly attached to the actual sideboard part via a hinged joint (12) and which, remote from the sideboard part, pivotingly carries one end of a support arm (13), the other end of which in said working position can be removably attached to the actual sideboard part (8*c*) remote from the bottom edge thereof by means of a clamping device (18).

8. A device according to claim 7, characterized in that said clamping device (18) is of the eccentric lock type.

9. A device according to claim 2, characterized in that the actual sideboard part (8*c*) essentially consists of a plastic sheet (8*c*) carried by a frame structure (10) of light metal profiled tubes.

* * * * *